US008500370B2

(12) United States Patent
Ditillo

(10) Patent No.: US 8,500,370 B2
(45) Date of Patent: Aug. 6, 2013

(54) EXCAVATION AND COMPACTION EQUIPMENT FOR THE CONSTRUCTION OF SCREW PILES

(75) Inventor: Alessandro Ditillo, Cesena (IT)

(73) Assignee: SOILMEC S.p.A., Cesena (FC) (IT)

( * ) Notice: Subject to any disclaimer, the term of this patent is extended or adjusted under 35 U.S.C. 154(b) by 267 days.

(21) Appl. No.: 12/763,853

(22) Filed: Apr. 20, 2010

(65) Prior Publication Data

US 2010/0263929 A1 Oct. 21, 2010

(30) Foreign Application Priority Data

Apr. 21, 2009 (IT) ..... TO2009A0312

(51) Int. Cl.
*E21B 7/26* (2006.01)

(52) U.S. Cl.
USPC ..... 405/232; 175/19; 175/232; 175/241

(58) Field of Classification Search
USPC ..... 405/232, 233, 236, 237, 240, 241, 405/242, 243; 175/232, 241, 242, 19
See application file for complete search history.

(56) References Cited

U.S. PATENT DOCUMENTS

| | | | | |
|---|---|---|---|---|
| 4,229,122 | A * | 10/1980 | Ballantyne | 405/129.3 |
| 4,819,744 | A * | 4/1989 | Caswell | 175/18 |
| 5,013,191 | A * | 5/1991 | Kitanaka | 405/233 |
| 2006/0260849 | A1 * | 11/2006 | Pedrelli | 175/386 |

FOREIGN PATENT DOCUMENTS

| | | |
|---|---|---|
| EP | 0 228 138 | 7/1987 |
| EP | 1 277 887 | 1/2003 |
| EP | 1 726 718 | 11/2006 |

* cited by examiner

*Primary Examiner* — David Bagnell
*Assistant Examiner* — Benjamin Fiorello
(74) *Attorney, Agent, or Firm* — Merchant & Gould P.C.

(57) ABSTRACT

Equipment for the construction of piles includes a drilling rod and a tool (10) mounted at a lower end thereof. The tool includes a hollow central shaft (11) with a door (18) for the concrete; a screw (12) integral with the shaft (11); a compactor (13) positioned along the screw (12); a base (14) of semicircular shape provided at the lower end of the screw (12); a plate (15) superimposed under the base (14) and rotating around the shaft (11) for alternatively assuming an open position, in condition of excavation wherein it superimposes on the base, and a reclosed position, in condition of compaction wherein it forms a surface circular with the base (14). Excavation teeth (16) are fixed to the lower end of the tool and an additional tooth (19) is constrained to the plate (15) that during the casting is outside of the tool in the condition of compaction.

4 Claims, 3 Drawing Sheets

EXCAVATION AND COMPACTION EQUIPMENT FOR THE CONSTRUCTION OF SCREW PILES

This application claims benefit of Serial No. TO 2009 A 000312, filed Apr. 21, 2010 in Italy and which application is incorporated herein by reference. To the extent appropriate, a claim of priority is made to the above disclosed applications.

BACKGROUND

The present invention relates to an excavation and compaction equipment for the construction of piles.

From the European patent EP 0 228 138 it is known an excavation and compaction equipment for the construction of piles comprising an antenna, a rotary table slidingly mounted along the antenna, a drilling rod actuated by the rotary table, and a tool, which is mounted at a lower end of the drilling rod itself.

The tool comprises, in its turn, a central body with an external diameter equal to an external diameter of the rod, an excavation screw integral with the central body, and a displacer element arranged along the rod immediately on the screw for compacting the walls of the excavation during the drilling.

As it is also described in the patent, the equipment undergoes a torsional moment on the drilling rod and a thrust on the excavation screw relatively elevated because the mass of the soil to be compacted during the excavation by the displacer element is of significant relevance and exerts also a strong resistance to the advancement of the tool in the soil itself. A similar solicitation brings to the need for making an equipment of huge size and, also, to the need of adequate motorizations, whose power, however, is fully used only during the drilling/compaction phase, but not during the extraction of the tool from the excavation, that is during the filling by means of concrete injection through the tool itself.

When a pile is carried out according to this technology without removal of soil, it is important to obtain a good consolidation of the walls of the excavation and a good anchoring of the pile in the soil.

In this regard, for increasing the contact surface between pile and soil, a screw groove is carried out in the cylindrical wall creating the so-called "screw displacement pile" or screw pile. During the casting phase, the concrete flows in all the cavity by filling also the helical grooving which has been just grooved in the soil, giving to the pile a screwed shape which improves the anchoring to the soil and therefore its relative carrying capacity.

Furthermore, the screw pile permits a huge saving on the total quantity of the concrete used because with the same carrying capacity the diameter of the central shaft can be appreciably lower with respect to the one of the piles compacted with a cylindrical surface.

From the European patent EP 1 277 887 B1 it is known an equipment for constructing screw piles, but the carrying out of the compaction during the descent phase falls in the above mentioned drawbacks (big thrusts and torques required contemporarily for the advancement, machines having a significant tonnage for bearing the enormous thrusts). Furthermore, the tooth carries out the grooving both during the descent and during the ascent phase when filling with concrete, by increasing at least the relative consumption and the possibility of ostacles or breakings during the descent. On the other hand, during the ascent, the concrete immediately fills the grooving giving to the pile the screw shape, during the descent the groove is probably filled by the following compaction giving thus to the excavation wall a non-homogeneous compaction surface.

From the European patent EP 1726718 A1 it is known the possibility of carrying out piles through compaction of the soil during the phase of ascent with inversion of the rotation direction, but this does not provide for the possibility of carrying out screw piles.

The standard tools for the compaction in advancement are characterized in that they all have a lower conical tract necessary for the first penetration and enlarging of the soil. This part is provided with screw which makes the material to go back up to the upper tract (characterized in that it has the maximum diameter) until it generates the compaction at the desired diameter. During the ascent, these tools must absolutely continue rotating in the same direction of the advancement phase, because otherwise the soil contained in the conical tract, being in the lower part of the casting, would contaminate the casting drastically reducing the strength of the pile obtained. On the other hand, the technique of tensioned compaction requires a counter-rotation for separating the part of the casting from the one wherein it is contained the soil to be compacted.

SUMMARY

The purpose of the present invention is to provide an excavation and compaction equipment for the construction of screw piles, which is free from the above described disadvantages.

In order to reach these and other purposes which will be better understood hereinafter, the present invention proposes to make an excavation and compaction equipment for the construction of screw piles.

BRIEF DESCRIPTION OF THE DRAWINGS

The invention will be now described with reference to the attached drawings, which show a non-limiting form of embodiment, wherein.

DETAILED DESCRIPTION

Figure 3:
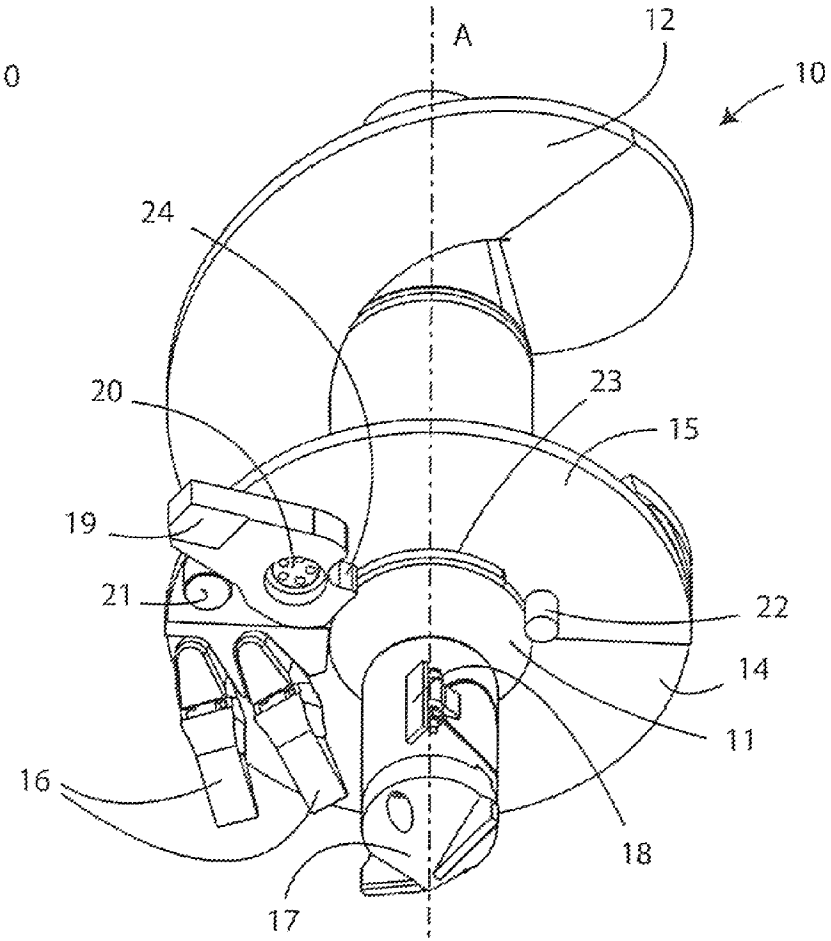
in FIGS. 3 and 4 it is shown the same equipment of FIGS. 1 and 2 in the same perspective views, but in compaction condition (ascent)

Excavation and compaction equipment 10 for the construction of piles shown in the figures is commonly constituted by a central shaft 11 around which develops at least a screw 12 provided with compaction surface 13 and ending with a substantially semicircular base 14.

Around the base rotates a plate 15 substantially semicircular too which, in excavation condition (FIGS. 1 and 2), assumes a reclosed position substantially fitting with base 14, underneath it, whereas in the compaction condition (FIGS. 3 and 4) assumes an open position for which, together with base 14, provides a substantially circular bottom surface and apt to divide the underlying zone used for the pile casting, from the overhanging one used for the compaction.

Furthermore, on plate 15 are also applied digging teeth 16, whereas at base 14 is applied a cylindrical appendix 17 having a door 18 for the outlet of the concrete.

According to the invention, a tool 19 is hinged on pivot 20 to the lower face of plate 15 in correspondence with a first stop 21 fixed to the plate too.

Eventually, a second stop 22 and a cam surface 23 are integral with shaft 11 by the part of appendix 17 which is subjected to a rotation relative with respect to plate 15.

Figure 1:
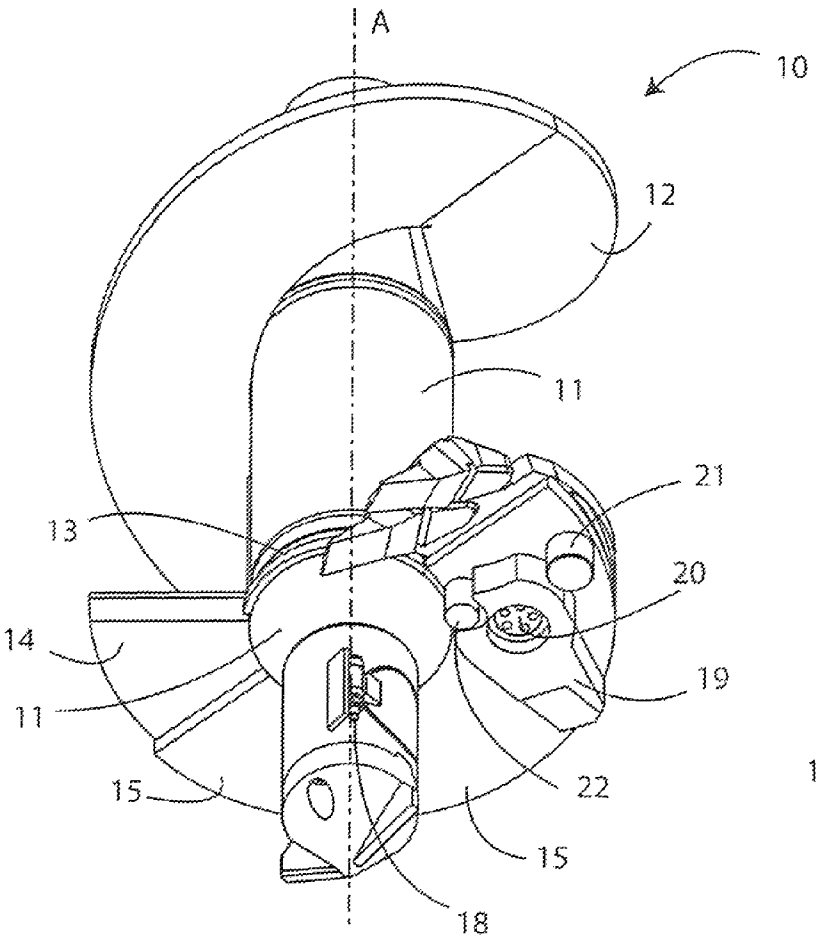
in FIGS. 1 and 2 it is shown the equipment according to the invention from a bottom and lateral perspective view respectively, in excavation condition (descent)
Figure 2:
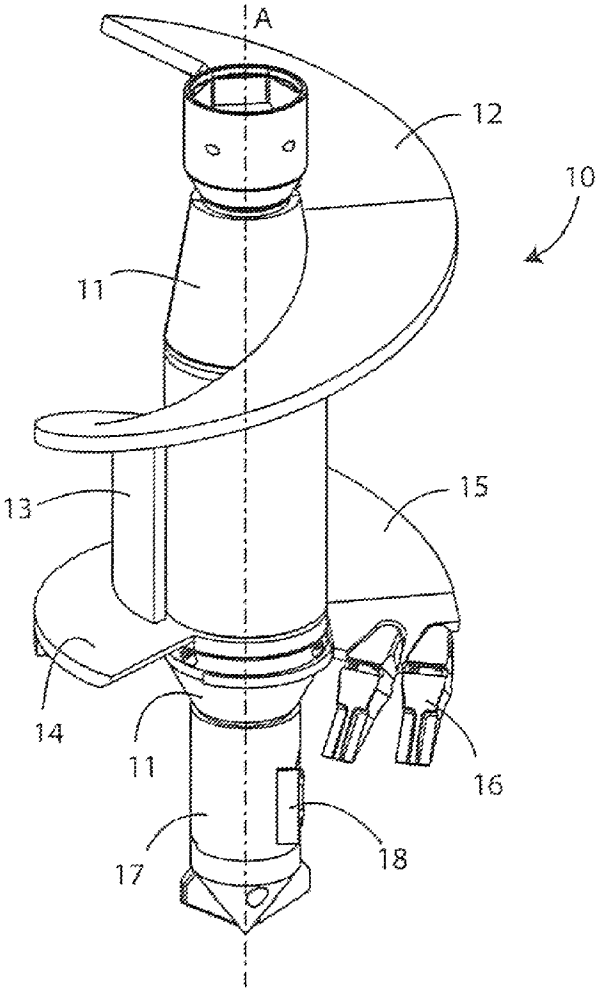
Figures 5, 6, 7, 8, 9, 10:
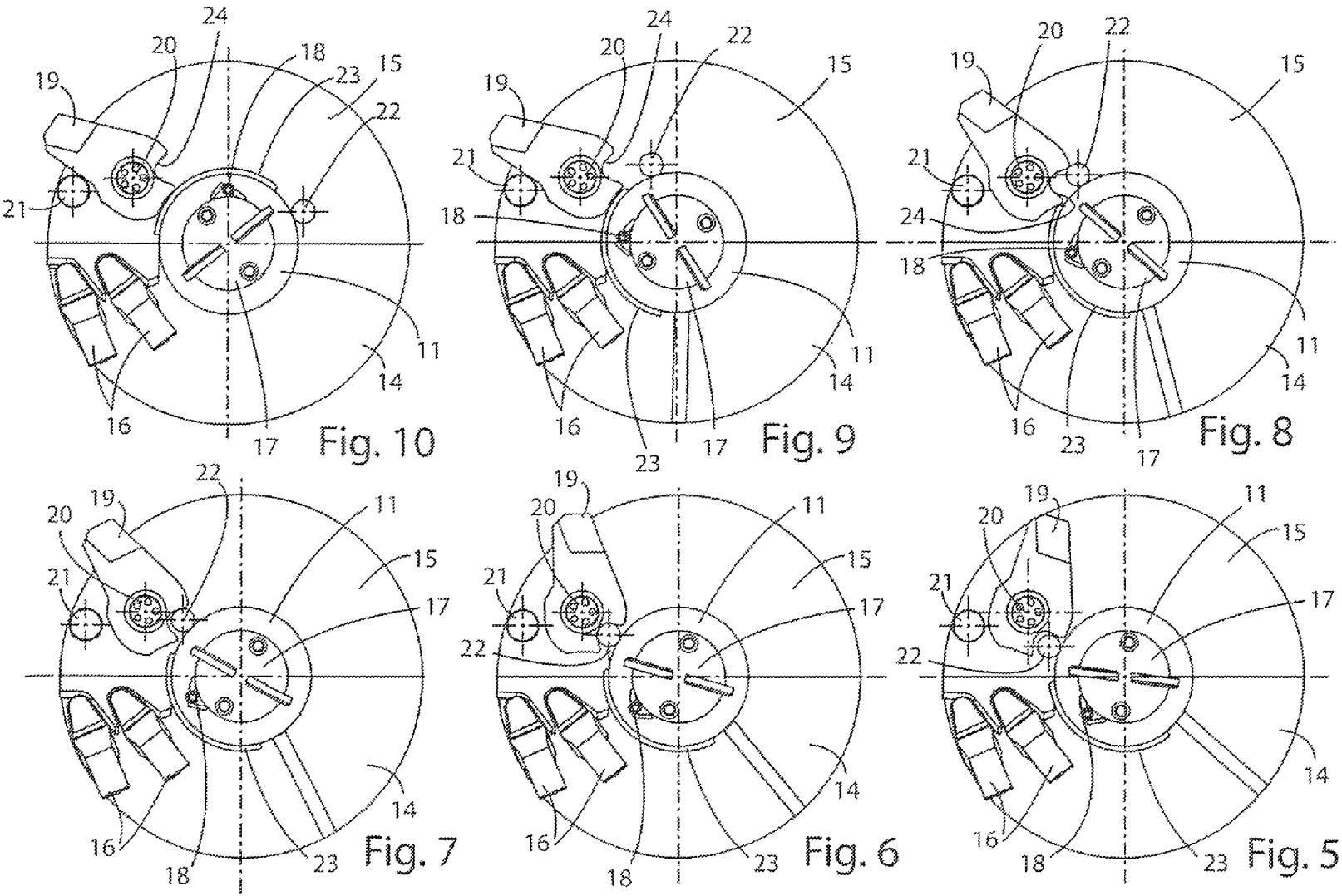
in FIG. 5-10 it is shown the equipment according to the invention, from a bottom view in the different working conditions.

In the descent or excavation configuration, shown in FIGS. 1, 2 and 5, tooth 19 will find itself reclosed inside the excavation diameter, with its seat 24 engaged into second striker 22 whereas plate 15 is open for the passage of debris along screw 12, toward the top of the equipment.

Figure 4:
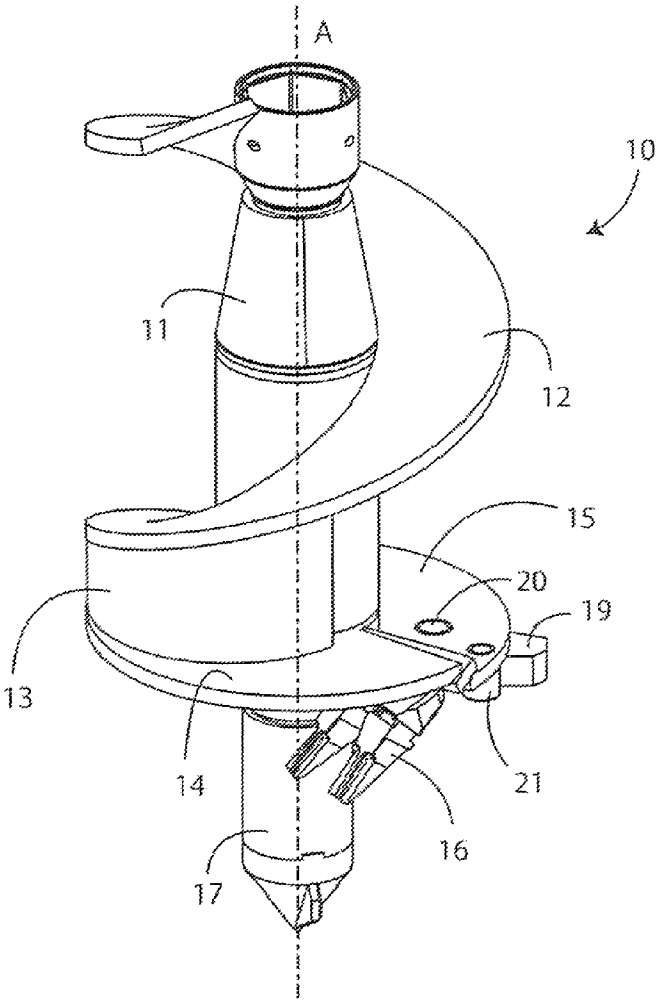

In the ascent or compaction configuration, shown in FIGS. 3, 4 and 10, tooth 19 will find itself open on the outside of the excavation diameter, after having rotated on hinging axis 20 up to the contact with the first stop 21, and with plate 15 closed, that is rotated for creating a circular surface with base 14, for obstructing the passage of debris towards the lower zone used for the casting.

The outlet of tooth 19 from the inner shape of the tool is produced by the rotation itself of plate 15 with respect to the parts integral with shaft 11 which, by forcing the contact between second stop 22 and corresponding cavity 24 on tooth 19 generates the rotation.

In fact, at the end of the descent phase, before going back up, is anyway performed the inversion of the rotation of axis A of the equipment for causing the closing of plate 15 and thus permitting the separation between the lower casting zone from openable door 18 and the upper compaction zone containing the soil.

As it is shown in FIG. 4, during the ending phase of outlet of tooth 19, cam 23 retains the tooth in locked position, preventing its return rotation.

The passage from the descent condition (excavation) to the ascent one (compaction) is shown in FIGS. 5-10 wherein it can be seen that when plate 15 (FIG. 6) begins to rotate for reclosing, tooth 19 leveraging second stop 22 begins to protrude from the shape of the equipment by rotating around its pivot 20 and little by little protrudes even more as plate 15 rotates (FIGS. 7 and 8), going away from second stop 22.

Finally, (FIGS. 9 and 10) tooth 19 begins the sliding on cam 23 striking against the first stop providing the locking of the teeth in this position till plate 15 begins again the rotation in opening. The first stop 21 has also the function of supporting tooth 19 during the excavation of the grooving, collaborating to the total resistance against the shearing forces. The counter-rotation of only tooth 19 is instead not permitted by the particular shape of its ending surface in contact with cam 23.

In order to carry out a screw pile shape with the optimal bearing, it is necessary to control the ascent (casting phase) by correlating the rotation speed and the one of the ascent in such a way as to obtain a constant pitch of the helical part. For doing this, a plc control device manages the drilling parameters on the machine by directly monitoring the rotation speed and the ascent speed, correlating them to the quantity of concrete material injected per unit time and retroacting controls on the pump for permitting the constancy of the pitches.

The possibility of carrying out screw piles by compacting the soil during the ascent of the tool permits to use a traction force much higher than the one applicable during the thrust, with equal weight of the machine permitting, therefore, also the use of machines having reduced size, contributing to the economy of the excavation, and to the easiness of transport of the equipment.

Furthermore, the movable tooth allows to carry out a faster excavation during the descent and without inconvenients of possible breakings due to the presence of stones or erratic blocks.

During the excavation phase, in fact, the drilling speed must be the fastest possible, hence the high speeds solicit to a greater extent all the parts in contact with the soil. During the ascent phase, instead, the speed is determined by the maximum pump delivery and, generally, is very slow, hence the protruding tooth is less solicited and can be simplified.

It is clear that on the same solution of compaction tool which works in tension, it is possible to apply a fixed tooth which always remains protruding for all the phases, but the advantages of a structure which penetrates in the soil without inconvenients of breakings and consequent machine downtimes would be lost.

In this kind of excavation equipment, taking place anyhow the rotation of the plate and having to keep inverted the direction of rotation during all the ascent phase, it is probable that the grooving carried out during the descent can disturb the one which is being executed during the ascent.

In fact, in the compaction and casting phase, the ascent must be adequately correlated to all the operating parameters and the presence of a previously executed grooving and having the same sense and direction of the one which is being made, can deflect tooth 19 by forcing it to go along a path not wanted. These deviations would bring the tool to work with consequent cracks, changes of direction or adjustments to the higher pitch, which would determine a scarce pile quality. In other cases, the presence of a previous grooving could constitute a preferential path for the material injected during the casting phase which would find thus an alternative escape way, flowing towards the upper part.

For these reasons, it is thought that the fixed tooth solution, even if practicable, is not to be preferred.

The movable tooth is also removable for facilitating the interchangeability in case of wears. The fact that it is removable, permits also to replace it with another which has a different shape, for instance with higher or lower thicknesses for obtaining a "crest" of the screw pile more or less solid. In fact, this one has to be correlated to the kind of soil and to the ascent pitch in such a way as to have a proportion between the section wherein it shearing works the soil (corresponding to the lateral surface comprised between two adjacent crests of cemented screw pile) and the one wherein it shearing works the concrete (crest section of the cemented screw pile).

Teeth 19 can be two teeth opposed for balancing the thrusts and obtaining a double spiral for the higher advantage of the carrying capacity and of the saving on the concrete (in this case it is possible to reduce even more the diameter of the central shaft).

Eventually, it is to be noted that the tooth/teeth can also slide between a retracted position within the shape of the tool and one extracted from the shape itself; in fact, it is not important to rotate or translate or anyhow move tooth 19, but to allow that at least in the compaction condition it protrudes from the shape of the tool.

The invention claimed is:

1. Excavation and compaction equipment for the construction of piles comprising a drilling rod rotating around a rotation axis and a tool mounted at a lower end of the drilling rod; the tool comprising:

a hollow central shaft provided at its lower end with a door for the outlet of the concrete;

at least a screw integral with the shaft;

means for compacting positioned along the screw;

a base of substantially semicircular shape at the lower end of the screw;

at least a plate of a shape that superimposes under the base and rotates relatively around the shaft for alternatively assuming an open position, in condition of excavation wherein the plate superimposes on the base, and a reclosed position, in condition of compaction wherein the plate forms a surface substantially circular with the base;

excavation teeth fixed to the lower end of the tool;

at least an additional tooth constrained to the plate so that during at least the phase of casting, the additional tooth is outside an excavation diameter of the tool in the condition of compaction;

the additional tooth being movable between two extreme positions, wherein a first one of the two positions of said tooth is inside the excavation diameter of the tool in the condition of excavation and a second one of the two positions is outside the excavation diameter of the tool in the condition of compaction; and wherein the tooth rotates between the two extreme positions, the equipment being provided with means for releasably blocking the tooth in said two extreme positions.

2. Equipment according to claim 1 wherein the means for releasably blocking the additional tooth comprise:

by a stop of the shaft inserting in a seat of the tooth in a releasable way when the tooth is in the position inside the shape of the tool; and by a cam of the shaft along which the tooth slides blocking the rotation around a pivot and a stop of the plate against which the tooth abuts when the tooth is in the position outside the shape of the tool.

3. Equipment according to claim 1 comprising two of the at least one additional tooth, which are located at opposed positions on the plate and work one against the other for balancing cut stresses.

4. Equipment according to claim 1 further comprising a PLC control System configured for recording parameters of rotation speed and for correlating the parameters to the quantity of concrete material injected, to control parameters of a pump for obtaining the required shape of the spiral pile.

* * * * *